United States Patent [19]

Bain, Jr.

[11] 4,357,519

[45] Nov. 2, 1982

[54] ELECTRIC FLATIRON HAVING A FRICTIONALLY RESTRAINED SWIVELED POWER CORD

[75] Inventor: Benjamin H. Bain, Jr., Monroe, Conn.

[73] Assignee: General Electric Company, New York, N.Y.

[21] Appl. No.: 189,071

[22] Filed: Sep. 22, 1980

[51] Int. Cl.[3] ..... D06F 75/28; H01R 13/56

[52] U.S. Cl. ..... 219/256; 38/79; 38/90; 174/46; 219/259; 219/533; 339/58; 339/101

[58] Field of Search ..... 219/245–259, 219/533; 174/46, 135; 339/101, 58; 38/74–92

[56] References Cited

U.S. PATENT DOCUMENTS

| | | | |
|---|---|---|---|
| 1,243,490 | 10/1917 | Denhard | 339/101 X |
| 1,961,013 | 5/1934 | Saraceno | 339/101 X |
| 2,416,984 | 3/1947 | Farr | 174/46 X |
| 2,512,062 | 6/1950 | Huffman | 339/101 X |
| 2,530,540 | 11/1950 | Reichold | 339/101 X |
| 2,540,575 | 2/1951 | Finizie | 339/101 X |
| 2,678,375 | 5/1954 | Gerber et al. | 339/101 X |
| 3,141,251 | 7/1964 | Olson et al. | 38/90 |
| 3,541,306 | 11/1970 | Barnas et al. | 219/245 |
| 3,593,442 | 7/1971 | Davidson et al. | 38/79 |

FOREIGN PATENT DOCUMENTS

| | | | |
|---|---|---|---|
| 462767 | 11/1968 | Switzerland | 38/92 |
| 1028442 | 4/1966 | United Kingdom | 219/256 |
| 676661 | 7/1979 | U.S.S.R. | 38/90 |

*Primary Examiner*—A. Bartis

*Attorney, Agent, or Firm*—John F. Cullen; George R. Powers; Leonard J. Platt

[57] ABSTRACT

An improved power supply cord connection to an electrically heated flatiron having a permanent connected power supply cord extending vertically from the rear of the flatiron handle permits the cord to frictionally swivel or pivot from front to back along the longitudinal axis of the handle in an elongated slot in the handle between a forward non-interference position when the flatiron is in a multi-point heel rest position and a rearward position preventing cord interference with the work during use of the flatiron.

The cord includes a bushing enclosing the cord conductors and an integrally formed enlarged head within the handle straddling the slot and locking the bushing therein. Transverse pivot ribs on the sides of the slot cooperate with notched friction bearing ears on the enlarged bushing end to allow the bushing to pivot between limit stops at the front and rear of the slot. Biasing means are provided so that the bushing is frictionally restrained to stay or lock in either the forward or rearward position. The cord bushing fills the slot and prevents entry of foreign matter into the iron therethrough.

5 Claims, 4 Drawing Figures

ELECTRIC FLATIRON HAVING A FRICTIONALLY RESTRAINED SWIVELED POWER CORD

BACKGROUND OF THE INVENTION

1. Field of the Invention

The invention relates to an improvement in a cord connection to an electric flatiron whereby the cord frictionally pivots or swivels from front to back along the longitudinal axis without gaps to the iron interior so there is no interference by the cord when the iron is in heel rest or ironing position.

2. Description of the Prior Art

In order to make electric flatirons more flexible for either right or left-handed use, it is common to have means whereby the connected cord may be pivoted from side to side or, may be permanently adjusted by the user to exit one side or the other from the rear of the iron so that the iron may be used flat by either hand with the cord in a non-interfering position. This side exit arrangement of the cord, either from the iron body or the handle, is well known. Also, it is common to use a stabilizing support means at the rear of the iron to support it in its upright inoperative heel rest position and such support means takes various forms as in U.S. Pat. No. 3,541,306 which has an upper handle support 80 with a side exit power cord 25 and a different form as in U.S. Pat. No. 3,593,442 of common assignment where the stabilizer 21 is disposed lower on the handle and is adaptable to a generally vertically exiting rear power cord forming a multiple point heel rest position as shown in FIG. 1. In such application, the power cord extends generally vertically from the back of the handle so the iron may be conveniently used from either side. In this latter patent, the stabilizer also provides a cord storage means when not in use. It is also known to use cords that freely swivel in a loose connection forward and back along the handle in a slot allowing access to the interior of the iron. Because of the generally vertically extending cord from the back portion of the handle, and the slight leaning to the rear when the iron is in the heel rest position, there can be interference with the flat surface on which the iron is resting depending on how far rearward the cord exits the iron handle. An improved cord connection is desired to avoid such interference when the iron is in the heel rest position and still maintain the cord high enough to avoid rubbing across the work when in ironing position.

SUMMARY OF THE INVENTION

Briefly described, the invention is directed to an electric flatiron with a handle having a connected plural conductor cord extending generally vertically from the rear or back of the handle and having a rear cover over the iron and internal conductor terminals. The rear cover has a stabilizer to support, with the handle, the iron in a multi-point heel rest position when the iron is not used. To this overall arrangement, an improvement is provided in the cord connection having a slot in the handle top and the cord bushing enclosing the conductors while filling the slot to prevent access to the iron interior. The cord bushing has an enlarged end inside the handle to straddle and lock the bushing in the slot with the bushing provided with transverse internal pivot means within the handle. Limit stops and biasing means are provided in the slot so the bushing frictionally swivels from front to back along the longitudinal handle axis between the stops whereby the cord may pivot to be frictionally restrained forward for non-interference when the iron is in heel rest position and assume a different fixed position preventing cord interference with the work during ironing position. Thus, the main object of the invention is to provide an improved iron cord connection in a vertically exiting rear handle cord to prevent access to the iron interior so the cord frictionally swivels from front to back of the iron handle to pivot out of the way when the iron is upright in the heel-rest position or in the ironing position.

DESCRIPTION OF THE PREFERRED EMBODIMENT

Figure 1:
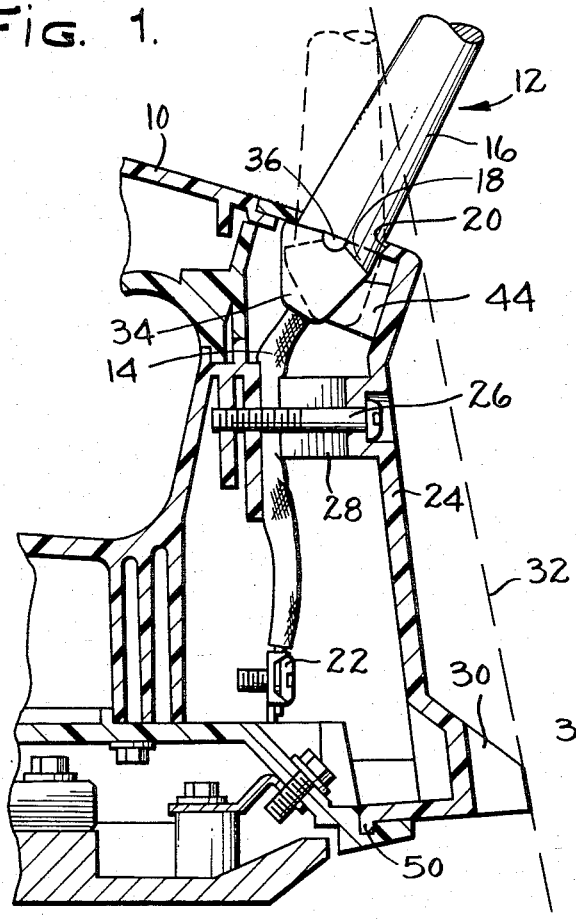
FIG. 1 is a partial sectional view of the rear portion of an iron employing the invention.

The invention is applicable to any cord connected flatiron where a forward-to-back friction swiveling of the power cord is desired but is primarily directed to a connected cord extending generally vertically from the back of the handle since such application does not require the user to adjust the cord by removing any parts of the iron. Any number of conductors in the cord may be used including those with the grounding conductor as will become apparent. Referring to FIG. 1, there is shown an electric flatiron handle 10 from which the usual plural conductor cord 12 extends generally vertically from the back of the handle with the conductors 14 enclosed and protected by elongated flexible sleeve bushing 16 surrounding the cord and anchored to the handle by an enlarged end 18 inside the handle straddling and locking the bushing inside a handle exit slot 20 extending front to back in the top of the handle in a well known manner. The cord extends out of the top of the handle at the rear for convenient use without dragging the fabric by a right or left-handed operator. After entering the handle, the cord has a portion generally separated into plural conductors 14 connected to internal electrical terminals 22 to supply power to the iron. In the newer irons, substantially all except the soleplate, may be a suitable molded plastic for lightness and coolness. The entire back of the iron is enclosed by a rear cover 24 suitably hooked in place and held by single bolt 26. To reduce strain on terminals 22, a suitable strain relief 28 engages conductors 14 as is customary.

For support in the heel rest position, a formed stabilizer 30 of the outrigger type generally shown in U.S. Pat. No. 3,593,442 supra is molded as part of rear cover 24 so the iron rests in a multiple, essentially a three-point, support when in the vertical heel rest position resting on a horizontal surface diagrammatically shown as 32 in FIG. 1.

Because of the curvature of iron handle 10 and the rear exit of the generally vertical cord 12 from the handle, the cord can interfere with the smooth resting of the iron on surface 32 when in heel rest position as shown in solid lines.

Figure 3:
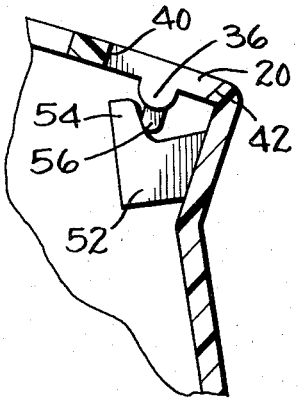
FIG. 3 is a sectional view on line 3—3 of FIG. 2.
Figure 4:
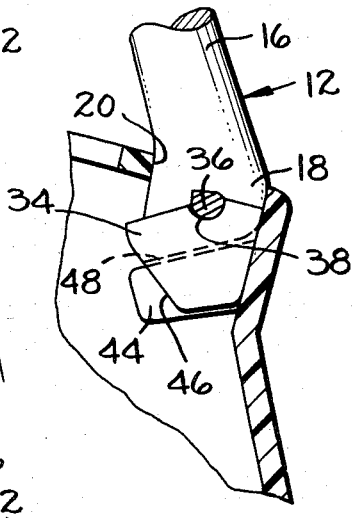
FIG. 4 is a sectional view on line 4—4 of FIG. 2.
Figure 2:
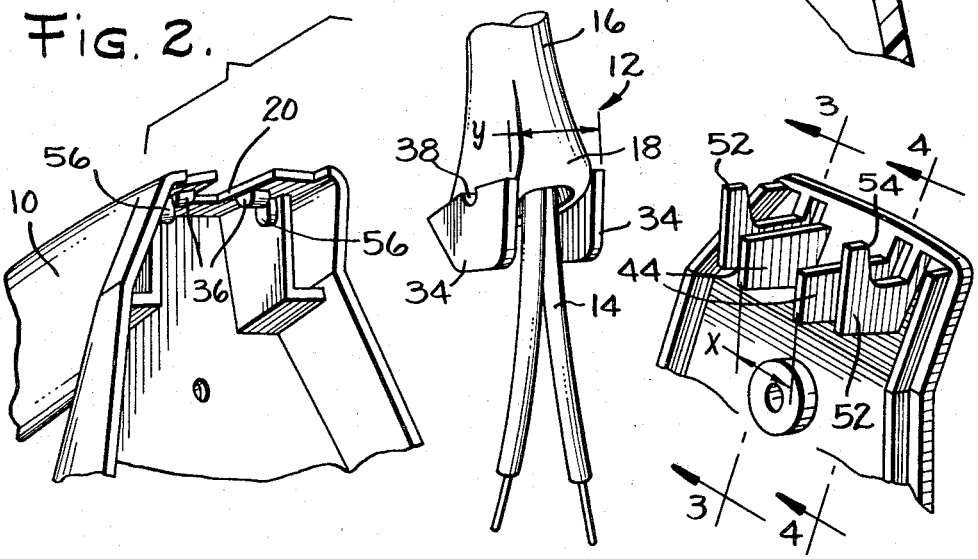
FIG. 2 is a partial exploded perspective of the cord/iron connection showing the pivot structure.

In accordance with the invention, an improvement in the cord iron connection permits frictional swiveling of the cord along the longitudinal handle axis from front to back or from the dotted position when the cord is in heel rest on surface 32 to the solid position when the cord is swiveled and the iron is in the horizontal use position as shown in FIG. 1. To this end, the improved connection comprises the slot 20 in the top of handle 10 through which the cord bushing 12 extends to fill the slot with its enlarged end 18 directly inside the handle to retain the cord. Preferably, the enlarged end has a general U-shaped extension of transversely spaced parallel bearing ears 34 that straddle and lock in the slot 20 by projecting beyond the slot transversely and longitudinally as seen in FIG. 4. This spaced parallel bearing ears 34 construction performs multiple functions as will become apparent. To provide the front-to-back frictional swiveling of bushing 16, transverse pivot ribs 36 are molded inside the handle on each side of slot 20 as shown in FIG. 2. To pivot bushing 16, each of the bearing ears 34 is provided with a cooperating pivot notch 38 in its upper straddling surface, the rib end notch engagement forming a transverse pivot axis for longitudinal swiveling of bushing 16 from the dotted to the solid position as shown in FIG. 1. Thus, the ears 34 straddle and lock the bushing in the slot 20 so the bushing pivots forward and backward a limited amount in and filling the slot 20 as shown in FIG. 1. To limit pivoting, forward and rear portions of the slot 20 may be tapered or formed to provide forward 40 and rear 42 stops in the handle and coverplate respectively as shown in FIG. 3.

For multiple functions, rear cover 24 is provided with a first pair of transversely spaced inwardly extending parallel ribs 44 that straddle and bound or confine internal conductors 14 to extend inside of bearing ears 34 ensuring that the bearing ears remain separated for positive locking in slot 20 by the overlapping or straddling arrangement of the ears in the slot in handle 10 to prevent the bushing being pulled out. The transverse spacing x between the cover ribs 44 is just slightly less than the transverse spacing y of the ears 34 so that there is some frictional engagement at 46 between each rib and adjacent ear to limit or prevent free swiveling while still preventing ears 34 from squeezing together and possibly out slot 20 i.e. prevent the bushing being pulled out. To maintain the main pivoting frictional engagement, each rib 44 has a top portion 48 abutting the enlarged bushing 18 to bias the pivot ribs 36 and matching notches 38 frictionally together holding the bushing locked in the handle for longitudinal pivoting and preventing the bushing dropping into the handle. This internal arrangement provides extra friction against pivoting and is what is intended by "internal friction pivot means" as used in the claims i.e. the bushing 16 does not freely swivel but is frictionally restrained to stay or lock in selected positions.

For locking the coverplate 24 in place, a lower formed hook 50 locks into the iron and a second pair of like outer transversely spaced and parallel inwardly extending cover ribs 52 are disposed spaced outwardly of the first pair of ribs 44. Suitable hook means 54 on the end of each rib 52 slide under corresponding ridge 56 formed in the rear portion of the iron handle 10 which overlaps to lock the cover in place on the iron at its top. The entire coverplate 24 is hooked at the top with hook 54 slid under ridge 56 and the coverplate then rotated clockwise to snap in the bottom of the iron at hook 50 and then secured in place by bolt 26.

The inner face of each rib 44 acting through its abutting portion 48 holds the cord bushing pivot notch 38 in contact with the handle pivot rib 36 preventing the bushing from falling down into the iron while maintaining the proper amount of friction for proper placement of the bushing during use i.e. fixedly forward in the dotted position or rearward in the solid position of FIG. 1. Additionally, the ribs 44 ensure the transverse or straddling spacing of ears 34 to prevent the bushing 16 from being pulled out of slot 20 while maintaining a supplementary friction between ears 34 and ribs 44 because of the x and y spacing dimensions for rubbing so the cord does not freely move or flop back and forth during pivoting but holds its position.

It will be apparent that the rear cover 24 with its first ribs 44 and second ribs 52 and hooks 54 and 50 is a one-piece molding. Also, overlapping straddling bushing ears 34 and the handle 10 or substantially the entire iron except for the soleplate are all of molded synthetic such as plastic thus requiring only three parts comprising the bushing, the iron itself including the handle, and the separable rear cover to provide the forward and back frictional swiveling along the longitudinal axis while filling the slot 20 for a pleasing appearance as well as preventing open gaps to permit foreign materials entering the interior through the handle.

The friction swivel arrangement provides essentially automatic self-positioning of the cord in different modes of iron operation. There is a high fixed vertical cord exit as shown solid in FIG. 1 that keeps the cord off the material being ironed in the use mode with either hand. When in heel rest, the weight of the iron tilting to the rear automatically overcomes the friction to allow the cord to pivot and hold in the dotted position of FIG. 1 to avoid any interference in store position. Then, when the iron is tipped to the horizontal use position, ironing movement overcomes the frictional swiveling resistance so the cord moves to the solid FIG. 1 or comfort position for the user and stays there by friction until it is put back on its heel to repeat the cycle. Thus, the cord exit automatically changes and stays put with the mode change and there is no floppiness of the cord swivel to allow the cord to assume other positions i.e. drag on the material or be uncomfortable to use by cord interference but rather there is restrained pivoting.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an electric flatiron having an elongated handle, a connected cord with internal conductors for supplying power to said flatiron and extending generally vertically from the back of the handle, a rear cover over the iron and internal conductor terminals connected to the cord, and, with the rear of the handle, supporting the iron in a multiple-point heel rest position, the improvement in said cord connection comprising:

said rear cover having a first pair of transversely spaced inwardly extending parallel ribs straddling and confining the internal conductors, an elongated slot extending front to back in the handle top, a cord bushing enclosing said conductors and disposed in the slot, said bushing having an integrally formed enlarged end within said handle straddling and locking said bushing directly in the slot, bushing limit stops in said slot at the front and rear thereof, said bushing being self-positioning and swivelling from front to back in said slot along a longitudinal handle axis between said stops, internal friction pivot means between said end and said handle with the pivot axis disposed transversely of said longitudinal axis of said handle permitting front to back pivoting of the bushing in the slot while closing the slot during pivoting therein.

said pivot means comprising a transverse pivot rib on each side of said slot, said bushing enlarged end having a U-shaped extension comprising a pair of transversely spaced parallel frictional bearing ears each with a pivot notch therein engaging with one of said pivot ribs, said ears straddling and locking in said slotby projecting beyond the slot, with each rib and notch engagement forming a transverse axis for said longitudinal swivelling, and said parallel cover ribs being disposed between said frictional bearing ears and maintaining said ears separated for said positive locking in said slot by said enlarged end, while permitting said cord to frictionally pivot into substantial fixed position for non-interference in normal ironing and in said heel rest position.

2. Apparatus as described in claim 8 wherein each rib of said first pair of cover ribs has a portion abutting the enlarged bushing end and biasing said pivot ribs and notches into frictional engagement holding said bushing locked in the handle and filling said slot.

3. Apparatus as described in claim 2 wherein the transverse spacing between said inwardly extending cover ribs is slightly less than the transverse spacing of said bushing bearing ears for sliding contact between each rib and adjacent ear for additional frictional swiveling by said bushing.

4. Apparatus as described in claim 3 wherein said cover has a second pair of outer transversely spaced parallel inwardly extending cover ribs disposed outwardly of said first pair of ribs, hook means on said second pair of ribs, and, means on said handle overlapping with said hook means to lock said cover in place on the iron.

5. Apparatus as described in claim 4 wherein said ribs, hook means, and overlapping means, handle, and rear cover are all molded plastic.

* * * * *

UNITED STATES PATENT AND TRADEMARK OFFICE

CERTIFICATE OF CORRECTION

PATENT NO. : 4,357,519

DATED : November 2, 1982

INVENTOR(S) : Benjamin H. Bain, Jr.

It is certified that error appears in the above—identified patent and that said Letters Patent is hereby corrected as shown below:

Col. 6, Line 4 - should read "Apparatus as described in claim 1....

Signed and Sealed this

*Fifteenth* Day of *February 1983*

[SEAL]

*Attest:*

GERALD J. MOSSINGHOFF

*Attesting Officer*

*Commissioner of Patents and Trademarks*